US006058913A

United States Patent [19]

Busato et al.

[11] Patent Number: 6,058,913

[45] Date of Patent: May 9, 2000

[54] EMISSION CONTROL VALVE WITH INTEGRAL FILTER

[75] Inventors: Murray F. Busato; John Edward Cook, both of Chatham, Canada

[73] Assignee: Siemens Canada Limited, Mississauga, Canada

[21] Appl. No.: 09/107,520

[22] Filed: Jun. 30, 1998

[51] Int. Cl.[7] ..... F02M 37/04

[52] U.S. Cl. ..... 123/520; 137/549

[58] Field of Search ..... 123/516, 518, 123/520; 137/549, 550

[56] References Cited

U.S. PATENT DOCUMENTS

| | | | |
|---|---|---|---|
| 4,543,983 | 10/1985 | Pauliukonis | 137/556 |
| 4,796,854 | 1/1989 | Ewing | 251/282 |
| 5,150,879 | 9/1992 | Mullally | 251/129.21 |
| 5,280,775 | 1/1994 | Tanamura et al. | 123/518 |
| 5,501,198 | 3/1996 | Koyama | 123/520 |
| 5,613,477 | 3/1997 | Maeda | 123/519 |
| 5,635,630 | 6/1997 | Dawson et al. | 123/520 |
| 5,906,189 | 5/1999 | Mukai et al. | 123/519 |
| 5,941,218 | 8/1999 | Deland et al. | 123/520 |

*Primary Examiner*—Thomas N. Moulis

[57] ABSTRACT

An emission control valve assembly has an internal main flow passage through a valve body between a first port and a second port, an electric actuator, and a valve operated by an armature of the actuator to selectively open and close the passage. A force-balancing mechanism applies to the valve a force that opposes force created by pressure differential between the first and second ports. An annular filter cartridge is disposed within the valve body to trap particulate material in flow entering through the first port so that the trapped material does not reach the valve and its seat.

19 Claims, 3 Drawing Sheets

EMISSION CONTROL VALVE WITH INTEGRAL FILTER

REFERENCE TO RELATED APPLICATIONS AND PRIORITY CLAIMS

This application expressly claims the benefit of earlier filing date and right of priority from the following two co-pending patent applications: U.S. Non-Provisional application Ser. No. 08/918,071 filed on Aug. 25, 1997 in the names of Cook et al and entitled "Automotive Emission Control Valve With A Counter-Force Mechanism"; and U.S. Non-Provisional Application Ser. No. 08/918,070 filed on Aug. 25, 1997 in the names of Cook et al and entitled "Automotive Emission Control Valve With A Cushion Media". The entirety of each of these two earlier-filed, co-pending patent applications is hereby expressly incorporated herein by reference.

FIELD OF THE INVENTION

This invention relates generally to on-board emission control systems for internal combustion engine powered motor vehicles, evaporative emission control systems for example, and more particularly to a new and unique emission control valve, such as a canister purge solenoid (CPS) valve for an evaporative emission control system.

BACKGROUND OF THE INVENTION

A known on-board evaporative emission control system comprises a vapor collection canister that collects fuel vapor emitted from a tank containing volatile liquid fuel for the engine and a CPS valve for periodically purging collected vapor to an intake manifold of the engine. A CPS valve comprises a solenoid that is under the control of a purge control signal generated by a microprocessor-based engine management system. The solenoid acts via an armature that positions a valve element relative to a valve seat to set the extent to which the CPS valve allows vapors to flow to the manifold.

One form of purge control signal is a duty-cycle modulated pulse waveform having a relatively low operating frequency, for example in the 5 Hz to 20 Hz range. The modulation may range from 0% to 100%. This means that for each cycle of the operating frequency, the solenoid is energized for a certain percentage of the time period of the cycle. As this percentage increases, the time for which the solenoid is energized also increases, and therefore so does the purge flow through the valve. Conversely, the purge flow decreases as the percentage decreases.

Changes in intake manifold vacuum that occur during normal operation of a vehicle may also act directly on a CPS valve in a way that upsets an intended control strategy unless provisions, such as a vacuum regulator valve in the purge flow path for example, are included to take their influence into account. When the CPS valve is closed, manifold vacuum at the valve outlet is applied to the portion of the valve element that is closing the opening bounded by the valve seat. Changing manifold vacuum affects certain operational characteristics of such a valve, potentially causing unpredictable flow characteristics.

The particular construction of a solenoid-actuated valve, and certain external influences thereon, may impair certain operational characteristics, such as the start-to-flow point and the incremental low-flow characteristic.

From commonly assigned U.S. Pat. No. 5,413,082, inter alia, it is known to incorporate a sonic nozzle function in a CPS valve to reduce the extent to which changing manifold vacuum influences flow through the valve during canister purging. From U.S. Pat. No. 5,373,822, it is known to provide pressure- or force-balancing of the armature/valve element.

From other patents, such as commonly assigned U.S. Pat. No. 4,901,974 issued Feb 20, 1990, it is known to incorporate noise-attenuating bumpers to absorb impact forces created by abutment of the armature with stops as the armature reciprocates.

Each of U.S. Pat. No. and U.S. application Ser. No. 08/918,071 discloses a canister purge solenoid (CPS) valve that is effective over a wide range of intake manifold vacuum levels to consistently cause the actual purge flow to more predictably equate to that intended by the purge control signal irrespective of changing intake manifold vacuum. That CPS valve integrates force-balancing and intake manifold vacuum de-sensitizing so that the start-to-flow duty cycle is significantly de-sensitized to changing intake manifold vacuum. It includes a sonic nozzle structure at its outlet. The valve exhibits quite consistent opening as its valve element unseats from the valve seat; it also exhibits quite consistent closing as the valve element reseats on the valve seat. Because of these consistencies, which are relatively quite well-defined and predictable, the duration within each duty cycle for which the sonic nozzle structure at the valve outlet functions as a true sonic nozzle is also quite well-defined and predictable, being equal to the duration of the duty cycle less the durations of valve element travel at initial valve unseating and at final valve re-seating where the proximity of the valve element to the valve seat prevents the sonic nozzle structure from operating as a true sonic nozzle, uninfluenced by the extent of flow restriction present between the unseated valve element and the valve seat. The sonic nozzle structure will therefore function as a true sonic nozzle over an entire duty cycle except for these initial unseating and final re-seating transitions. By making the valve element travel during which these transitions occur relatively short, the sonic nozzle structure can function as a true sonic nozzle over a larger portion of a duty cycle. Therefore, actual mass purge flow that will occur during a duty cycle may be accurately correlated to the purge control duty cycle signal, and hence made well-defined and well-predictable.

Because of the improvements provided by these valves, it is believed that certain particulate material entrained with the purge flow may create noticeable effects on valve performance. Particulate material may hang up within the valve, and if this occurs proximate the valve seat, the ability to properly seal the valve assembly to the seat may be at issue. Accordingly, it is believed desirable to provide a solution for such contingency, especially because a purge valve is not typically disassembled for periodic maintenance service during its life in a motor vehicle.

SUMMARY OF THE INVENTION

One aspect of the present invention relates to an emission control valve assembly comprising a body having an internal flow passage between a first port and a second port, an annular valve seat in circumscribing relation to the passage, an actuator operating a valve relative to the valve seat to selectively restrict flow through the passage, and an annulus disposed in circumscribing relation to the seat and the valve and comprising a particulate filter medium through which flow through the passage is constrained to pass.

Another aspect of the present invention relates to a canister purge valve assembly for an evaporative emission control system comprising a body having an internal flow passage between an inlet port and an outlet port, an annular valve seat in circumscribing relation to the passage, an actuator operating a valve relative to the valve seat to selectively restrict purge flow through the passage, and a particulate filter disposed to trap certain particulate material in flow that enters the inlet port so that the trapped material does not reach the valve and seat.

Still another aspect of the present invention relates to an evaporative emission control system for a fuel supply system of an automotive vehicle comprising a purge flow path extending between an evaporative emission containment space and an engine, including a purge valve assembly for purging fuel vapors from the containment space to the engine under conditions conducive to purging, wherein the purge valve assembly comprises a body having an inlet port communicated to the containment space and an outlet port communicated to the engine, a flow passage through the body between the inlet port and the outlet port, an annular valve seat in circumscribing relation to the passage, an actuator operating a valve relative to the valve seat to selectively restrict flow through the passage, and a particulate filter disposed to trap certain particulate material in flow that enters the inlet port so that the trapped material does not reach the valve and seat.

Within the foregoing general aspects, further ancillary aspects of the present invention relate to certain features of the particulate filter, and to its association with certain portions of an emission control valve, including integration with a force-balancing mechanism, particularly in a canister purge valve.

BRIEF DESCRIPTION OF THE DRAWINGS

The accompanying drawings, which are incorporated herein and constitute part of this specification, include one or more presently preferred embodiments of the invention, and together with a general description given above and a detailed description given below, serve to disclose principles of the invention in accordance with a best mode contemplated for carrying out the invention.

DESCRIPTION OF THE PREFERRED EMBODIMENT

Figure 1:
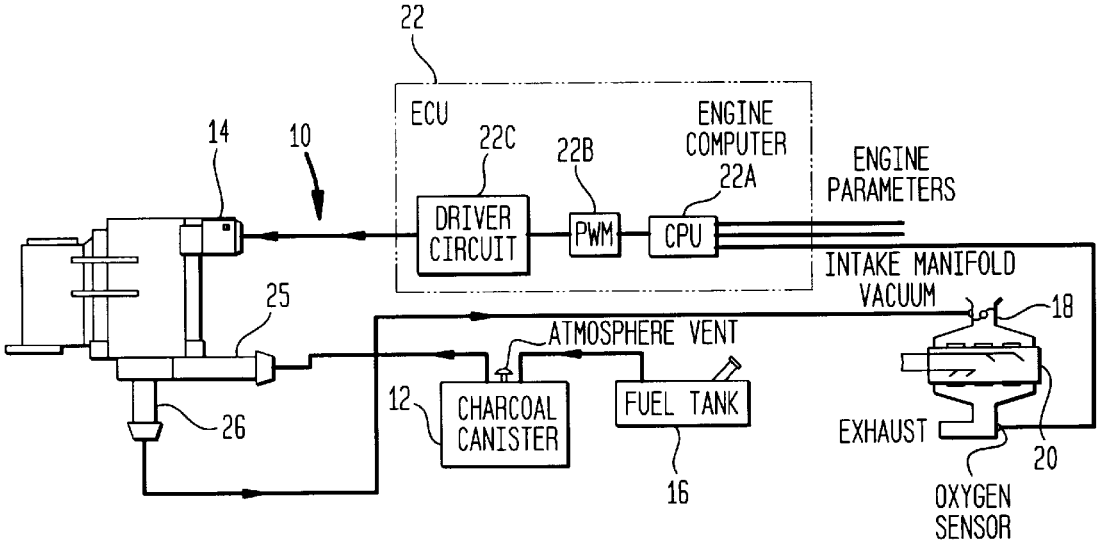
FIG. 1 is a schematic block diagram of an emission control system containing an exemplary emission control valve embodying principles of the present invention.

FIG. 1 illustrates an evaporative emission control system 10 of a motor vehicle. System 10 comprises a vapor collection canister (charcoal canister) 12 and a CPS valve 14, embodying principles of the present invention, connected in series flow relationship between a fuel tank 16 of the vehicle and an intake manifold 18 of an internal combustion engine 20 that utilizes fuel stored in tank 16 to power the vehicle.

An electronic engine control unit (ECU) 22 comprises an engine computer 22A that processes various input signals through one or more stored algorithms to develop an output signal for controlling valve 14. ECU 22 also contains a pulse width modulator (PWM) circuit 22B that generates a pulse waveform whose pulse width is modulated by the output signal from computer 22A. ECU 22 further comprises a driver circuit 22C that boosts the power of the pulse width modulated waveform of circuit 22B to a level suitable for operating valve 14.

Detail of valve 14 appears in FIGS. 2–5. Valve 14 comprises a body 24 having an inlet port 25, an outlet port 26, and an internal flow passage extending between the two ports. Body 24 includes a part 27 fabricated from suitable fuel-tolerant material by a process such as injection molding to contain the two ports as integral nipples. The nipple that forms outlet port 26 includes a sonic nozzle structure 28 and terminates internally of body 24 at an annular surface forming a valve seat 29 that circumscribes the internal flow passage between the two ports.

Valve 14 further comprises a solenoid assembly 30 that is housed within an overmold 32. Overmold 32 and body part 27 join at a joint 34 to cooperatively form body 24. Solenoid assembly 30 comprises a polymeric bobbin 38 having a central tubular core 40 and respective radially directed annular end walls 48, 50 at respective axial ends. Core 40 and outlet port 26 are coaxial with an imaginary longitudinal axis 44 of valve 14. A circular cylindrical through-hole 46 that is open at opposite axial ends extends through core 40. An electromagnet coil 42 is disposed around core 40 between end walls 48, 50. Coil 42 is created by winding a length of magnet wire around core 40 between end walls 48, 50 and joining its respective terminations to respective electric terminals 52, 54 whose proximal ends are mounted on wall 48. Distal ends of these terminals project radially, passing through overmold 32 to the exterior of body 24 where they are laterally bounded by a surround 56, which is an integral formation of the overmold, thereby endowing valve 14 with an external electric connector for mating connection to a complementary connector (not shown) leading to ECU 22.

Solenoid assembly 30 further comprises magnetic circuit structure for concentrating magnetic flux generated by coil 42 when electric current is delivered to the coil via terminals 52, 54. The magnetic circuit structure comprises an armature 58 and a multi-part stator structure that comprises stator parts 60, 62, and 64.

Stator part 60 is a generally cylindrical pole piece that is disposed at one end of solenoid assembly 30 coaxial with axis 44. Stator part 62 is another pole piece that is disposed at the opposite end of solenoid assembly 30 coaxial with axis 44. Stator part 64 is a part that completes the magnetic circuit between the two stator pole piece parts 60, 62 exterior of the coil and bobbin. The magnetic circuit includes an air gap 65 between stator part 60 and armature 58; it also includes a gap between armature 58 and stator part 62, the gap being occupied by material of bobbin 38.

A portion of stator part 64 comprises a cylindrical wall 66 which is disposed coaxial with axis 44 and with which a head 67 of stator part 60 has a threaded engagement. Overmold 32 stops short of wall 66, comprising a cylindrical surround 32A, to allow external access to stator part 60. Head 67 comprises a tool engagement surface 68, a noncircular socket for example, that is accessible through surround 32A for engagement, and ensuing rotation about axis 44, by a complementary shaped tool (not shown) to adjust the axial position of part 60 along axis 44. A portion of a shank 69 passes from head 67 to enter through-hole 46 at one axial end. A reduced diameter, distal end portion 71 of shank 69 extending from a shoulder 70 of shank 69 ends in a flat circular end surface 72 perpendicular to axis 44.

Through-hole 46 has an internal circular shoulder 73 that demarcates a smaller diameter portion through which shank 69 enters, from a larger diameter portion within which armature 58 is disposed. Armature 58 comprises a cylindrical shape adapted for axial motion within through-hole 46 with radial clearance to the wall of the through-hole. Armature 58 has a central through-hole 58A coaxial with axis 44. One axial end of armature 58 is in juxtaposition to end surface 72 of stator part 60. That end has a circular shoulder 75 around its perimeter and an impact absorbing cushion 74 at its center. The opposite axial end portion of armature 58 protrudes from through-hole 46 to terminate in a flat circular end surface perpendicular to axis 44.

When acted upon by magnetic force arising from magnetic flux in the magnetic circuit, armature 58 will not necessarily move with solely an axial component of motion. The motion may be accompanied by a radial, or lateral, component. In order to attenuate undesired consequences, such as noise, resulting from such lateral motion, an impact absorbing cushion 80 is disposed in a circular counterbore 81 of bobbin 38 at the adjoining end of through-hole 46. The illustrated cushion 80 comprises an elastomeric ring circumscribing armature 58, but without imposing any significant influence on desired axial motion of the armature. Cushion 80 is disposed on the inner margin of an annular mounting member 82 whose outer perimeter engages the wall of a further counterbore 84 in bobbin end wall 50 adjoining counterbore 81, thereby lodging the cushion-retainer assembly in place. Alternatively, cushion 80 and mounting member 82 may be separate parts arranged such that the latter holds the former in place.

A multi-part valve assembly 86 is assembled to armature 58. One of the parts is a valve head 88, and another, a seal 90. A force-balancing mechanism 92 is associated with valve assembly 86. Mechanism 92 comprises an annular convoluted diaphragm 94 and a retainer 96. The valve assembly and force-balancing mechanism are held in assembly relation with armature 58 by a fastener 98.

Figure 2:
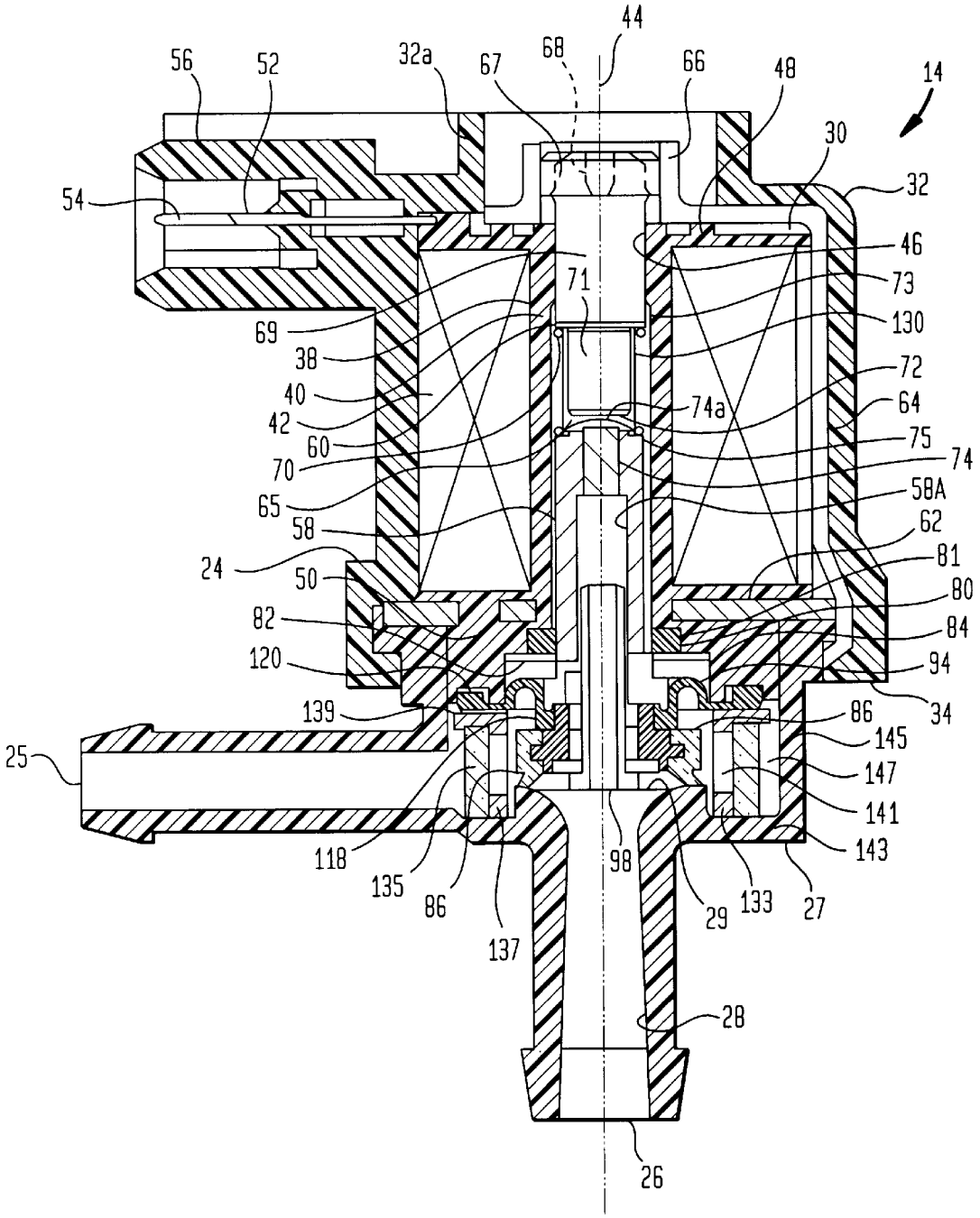
FIG. 2 is a longitudinal cross section view through the exemplary emission control valve of FIG. 1.
Figure 3:
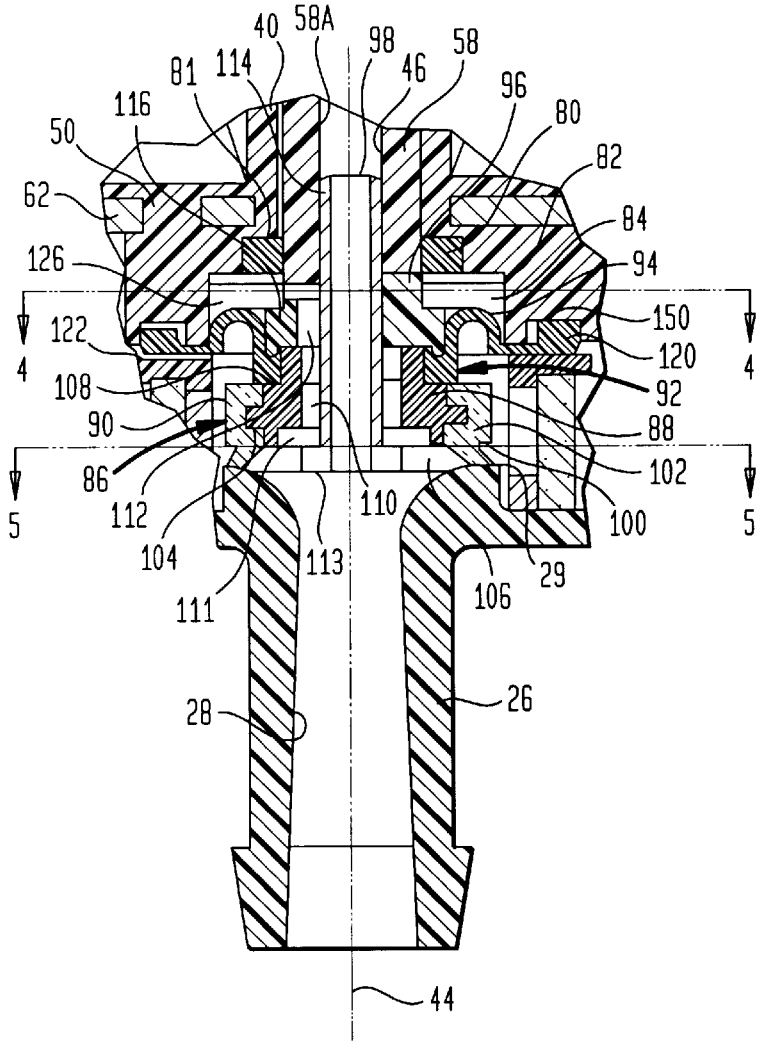
FIG. 3 is an enlarged fragmentary view of a portion of FIG. 2.
Figure 4:
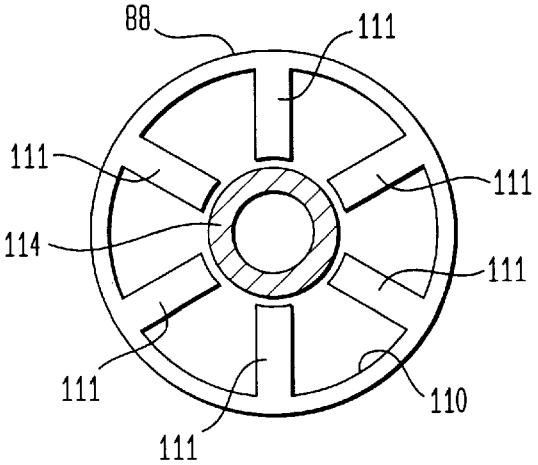
FIG. 4 is a fragmentary transverse cross section view in the direction of arrows 4–4 in FIG. 3.
Figure 5:
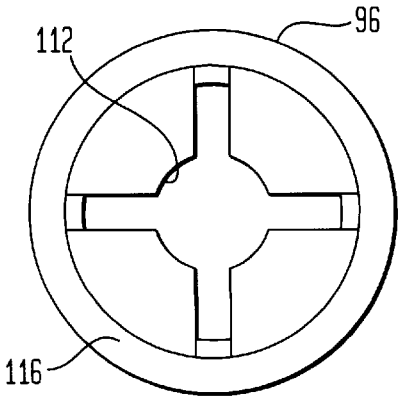
FIG. 5 is a fragmentary transverse cross section view in the direction of arrows 5–5 in FIG. 3.

Head 88 is generally cylindrical but includes a radially protruding circular ridge 100 midway between its axial ends. Seal 90 comprises a ring-shaped circular body 102 with a groove 104 on its inside diameter providing for body 102 to fit onto the outside diameter of head 88 with ridge 100 lodging in groove 104. A frustoconical sealing lip 106 flares radially outward from the end of body 102 that is toward seat 29. FIGS. 2 and 3 show lip 106 sealing against seat 29 such that valve assembly 86 is closing the internal passage between ports 25 and 26. This is the closed position of valve 14. When valve mechanism 86 is displaced away from the closed position, lip 106 unseals, opening the passage. The extent to which valve mechanism 86 restricts flow through the passage depends on the extent to which lip 106 is displaced away from seat 29.

Head 88 further comprises an external shoulder 108 at its axial end that is opposite sealing lip 106. Head 88 also comprises a central axially extending through-hole 110. The end of head 88 that is proximate sealing lip 106 comprises a series of circumferentially spaced fingers 111 directed radially inward of the through-hole.

Retainer 96 also has a generally cylindrical shape and comprises a central through-hole 112. The wall of this through-hole is fluted, comprising circumferentially spaced apart, axially extending flutes. Head 88 and retainer 96 are stacked together axially, and the stack is secured to armature 58 by fastener 98 having a press fit to armature 58. Fastener 98 is a hollow tube that has a head 113 and a shank 114. Head 113 bears against radially inner ends of fingers 111, but does not block passage through through-hole 110. Shank 114 passes with clearance through head 88 and retainer 96 and into force-fit with armature through-hole 58A, causing retainer 96 to abut the end of armature 58 around through-hole 58A. In this way, valve assembly 86 and armature 58 are secured together for motion in unison.

Retainer 96 further comprises a flange 116 that radially overlaps shoulder 108 of head 88. In assembly, flange 116 and shoulder 108 capture a bead 118 on the inner margin of diaphragm 94 to seal the I.D. of the diaphragm to the O.D. of valve assembly 86. The outer margin of diaphragm 94 comprises a bead 120 that is captured between confronting surfaces of bobbin end wall 50 and an annular filter assembly, or filter cartridge, 122. Member 94 and counterbore 84 in bobbin end wall 50 cooperatively form an internal chamber space 126 as part of force-balancing mechanism 92.

A helical coil bias spring 130 is disposed about the distal end of part 60 with one of its axial ends bearing against shoulder 70 and its opposite end bearing against shoulder 75. When no electric current flows in coil 42, spring 130 forces lip 106 against valve seat 29. This loses the internal flow passage between inlet port 25 and outlet port 26. Pressure at outlet port 26 is however communicated to chamber space 126 through a communication passage provided via the through-holes in head 88 and retainer 96.

Filter cartridge 122 comprises a ring 133 that provides structural support for a particulate filter medium 135. Ring 133 has a circular annular side wall 137 that is coaxial with axis 44 and a circular flange 139 that protrudes radially outward a short distance from one axial end of side wall 137. Side wall 137 contains several circumferentially spaced apart through-holes 141. Filter medium 135 comprises a circular ring that snugly girdles side wall 137 in covering relation to the outside of through-holes 141. The ring forming filter medium 135 has generally uniform radial thickness, slightly less than the radial dimension of flange 139. It also has generally uniform axial length with one of its axial ends being disposed against flange 139. The axial length of the ring forming filter medium 135 is substantially equal to the overall axial length of the outside of side wall 137.

Body part 27 has an end wall 143 through which the nipple forming outlet port 26 passes and a circular side wall 145 extending axially from end wall 143 coaxial with axis 44. The nipple forming inlet port 25 radially intersects side wall 145. The two walls 143, 145 bound a portion of an internal chamber space 147 of body 24 that is coaxial with axis 44. It is within chamber space 147 that filter cartridge 122 is coaxially disposed.

Valve seat 29 is raised from end wall 143 within chamber space 147 so as to be circumferentially bounded by cartridge 122. Hence, the variable restriction that is provided by the positioning of seal 90 relative to seat 29 is similarly bounded by the cartridge. Flow through the internal passage between ports 25, 26 is constrained to pass through cartridge 122 because one axial end of the cartridge seals against end wall 143 and the opposite axial end seals against bead 120. Bobbin end wall 50 is disposed axially relative to body part 27 such that bead 120 is captured by flange 139 within a circular groove 150 in an end face of wall 50 surrounding counterbore 84. This not only seals the axial end of cartridge 122 to bobbin 38, but also enseals the perimeter of space 126. FIGS. 2 and 3 show that cartridge 122 has radial clearance to side wall 145 around its full circumference so that none of the through-holes 141 is restricted by the valve body wall.

The delivery of a purge control signal from ECU 22 to valve 14 creates electric current flow in coil 42, and this current flow creates magnetic flux that is concentrated in the above-described magnetic circuit. As the current increases, increasing force is applied to armature 58 in the direction of increasingly displacing valve assembly 86 away from seat 29. This force is countered by the increasing compression of spring 130. The extent to which valve assembly 86 is displaced away from seat 29 is well-correlated with the current flow, and because of force-balancing and the sonic flow, the valve operation is essentially insensitive to varying manifold vacuum. The maximum displacement of armature 58 and valve assembly 86 away from seat surface 29 is defined by abutment of a domed head 74A of cushion 74 with flat end surface 72 of stator part 60.

In the operative emission control system 10, intake manifold vacuum is delivered through outlet port 26 and will act on the area circumscribed by the seating of lip 106 on seat 29. Absent force-balancing, varying manifold vacuum will vary the force required to open valve 14 and hence will cause the current flow in coil 42 that is required to open the valve to vary. Force-balancing de-sensitizes valve operation, initial valve opening in particular, to varying manifold vacuum. In valve 14, force-balancing is accomplished by the aforementioned communication passage through valve assembly 86 to chamber space 126. By making the effective area of the movable wall portion of chamber space 126 equal to the area circumscribed by the seating of lip 106 on seat 29, the force acting to resist unseating of the closed valve assembly 86 is nullified by an equal force acting in the opposite axial direction. Hence, valve 14 is endowed with a well-defined and predictable opening characteristic which is important in achieving a desired control strategy for canister purging. Although once valve assembly 86 has unseated from seat 29 some counter-force continues to exerted on it by the force-balance mechanism, the counter-force will, generally speaking, progressively diminish along a gradient as the valve increasingly opens.

Once the valve has opened beyond an initial unseating transition, sonic nozzle structure 28 becomes effective as a true sonic nozzle (assuming sufficient pressure differential between inlet and outlet ports) providing sonic purge flow and being essentially insensitive to varying manifold vacuum. Assuming that the properties of the vapor being purged, such as specific heat, gas constant, and temperature, are constant, mass flow through the valve is a function of essentially only the pressure upstream of the sonic nozzle. The restriction between the valve element and the valve seat upon initial valve element unseating and final valve element reseating does create a pressure drop preventing full sonic nozzle operation, but because these transitions are well-defined, and of relatively short duration, actual valve operation is well-correlated with the actual purge control signal applied to it. The inventive valve is well-suited for operation by a pulse width modulated (PWM) purge control signal waveform from ECU 22 composed of rectangular voltage pulses having substantially constant voltage amplitude and occurring at selected frequency.

The constructions of valve assembly 86 and force-balancing mechanism 92 are advantageous. Although the materials of valve head 88, diaphragm 94 and seal 90 are polymeric, they may have certain diverse characteristics. Seal 90 may have a characteristic that allows it to be molded directly onto valve head 88. Such compatibility may not exist between the material of diaphragm 94 and valve head 88. Hence retainer 96, its stacked association with valve head 88, and the use of fastener 98, as herein disclosed, provides a construction that accomplishes the required sealing of both the diaphragm and the seal element to the valve head.

Once all the internal parts of valve 14 have been assembled to body part 27, overmold 32 is created to complete the enclosure. The overmold is created by known injection molding techniques. At joint 34 the overmold material seals to body part 27. Similar sealing occurs around terminals 52, 54. Overmold material encloses the entire side of solenoid 30. At the base of wall 32A overmold material also forms a seal, but leaves access to stator part 60. Stator part 60 provides for proper calibration of the valve by setting the start-to-open point in relation to a certain current flow in coil 42.

The inclusion of filter cartridge 122 traps certain particulate material that may be entrained with the purge flow passing into the valve through inlet port 25. Because the cartridge surrounds valve assembly 86 and seat 29, such material is prevented from reaching the seat area and possibly interfering with the sealing action of lip 106 on the seat. The spacing of the perimeter of the cartridge from side wall 145 provides an annular space where the trapped particulate material can collect. Several media are suitable for filter medium 135, paper, foam, woven mesh, and perforated sheet, being four examples. The woven mesh may comprise woven metallic or woven synthetic wires. A perforated sheet may be metallic or synthetic material. The medium should have a porosity sufficient to trap foreign particles greater than a certain size without imposing any significant pressure drop to purge flow. The number, shape, and location of through-holes 141 is also chosen to avoid creation of any significant pressure drop. If filter cartridge 122 is intended to not be a serviceable part of a valve assembly, it may be designed to pass particulate matter of a size that has been demonstrated to reliably pass through the valve seat without impairing valve operation, while trapping larger particulate matter. This may avoid needless premature clogging of the filter medium that could impair a valve's ability to perform reliably over its expected useful life. The combination of various features are believed to provide a valve that has improved performance, durability, and noise attenuation over its useful life.

It is to be understood that because the invention may be practiced in various forms within the scope of the appended claims, certain specific words and phrases that may be used to describe a particular exemplary embodiment of the invention are not intended to necessarily limit the scope of the invention solely on account of such use.

What is claimed is:

1. An emission control valve assembly comprising a body having an internal flow passage between a first port and a second port, an annular valve seat in circumscribing relation to the passage, an actuator operating a valve relative to the valve seat to selectively restrict flow through the passage, and an annulus disposed in circumscribing relation to the seat and the valve and comprising a particulate filter medium through which flow through the passage is constrained to pass.

2. An emission control valve assembly as set forth in claim 1 in which the annulus comprises a structural support ring having an annular side wall containing at least one through-hole, and the filter medium comprises a ring circumferentially girdling the annular side wall of the support ring in covering relationship to the outside of the at least one through-hole.

3. An emission control valve assembly as set forth in claim 2 in which the valve body comprises an end wall and an annular side wall extending from the end wall to bound an internal chamber space within the valve body, the valve seat is disposed on the end wall, and the annulus comprises an axial end sealed to the valve body end wall in circumscribing relation to the valve seat.

4. An emission control valve assembly as set forth in claim 3 in which the filter medium is spaced from the valve body side wall to leave an annular zone of the chamber space surrounding the filter medium.

5. An emission control valve assembly as set forth in claim 4 in which the actuator comprises a solenoid comprising an electromagnet coil mounted on a bobbin, and the annulus comprises an opposite axial end sealed to the bobbin.

6. An emission control valve assembly as set forth in claim 5 in which the support ring comprises a radial flange at the opposite axial end of the annulus, the radial flange sealing to the bobbin.

7. An emission control valve assembly as set forth in claim 1 further including a counter-force mechanism that, the valve is closing the passage, applies a counter-force to the valve opposite the force due to pressure differential between the first and second ports, the counter-force mechanism including a chamber space that is internal to the body and bounded in part by a fluid-impermeable movable wall that is sealed to the valve, and a communication passage that communicates one of the ports to the chamber space when the valve is closing the passage, wherein the valve comprises plural parts in assembly relation, one of the plural parts being a valve head and another of the plural parts being a retainer, the valve head and the retainer coacting to hold the movable wall sealed to the valve, and the annular filter element sealing to a portion of the movable wall.

8. A canister purge valve assembly for an evaporative emission control system comprising a body having an internal flow passage between an inlet port and an outlet port, an annular valve seat in circumscribing relation to the passage, an actuator operating a valve relative to the valve seat to selectively restrict purge flow through the passage, and a particulate filter disposed to trap certain particulate material in flow that enters the inlet port and flows in a radial direction through the filter so that the trapped material does not reach the valve and seat.

9. A canister purge valve assembly as set forth in claim 8 further including a counter-force mechanism that, when the valve is closing the passage, applies a counter-force to the valve opposite the force due to pressure differential between the inlet and outlet ports.

10. A canister purge valve assembly for an evaporative emission control system comprising a body having an internal flow passage between an inlet port and an outlet port, an annular valve seat in circumscribing relation to the passage, an actuator operating a valve relative to the valve seat to selectively restrict purge flow through the passage, and a particulate filter disposed to trap certain particulate material in flow that enters the inlet port so that the trapped material does not reach the valve and seat, wherein the filter comprises an annulus disposed in circumscribing relation to the seat and comprising a particulate filter medium through which flow through the passage is constrained to pass.

11. A canister purge valve assembly for an evaporative emission control system comprising a body having an internal flow passage between an inlet port and an outlet port, an annular valve seat in circumscribing relation to the passage, an actuator operating a valve relative to the valve seat to selectively restrict purge flow through the passage, and a particulate filter disposed to trap certain particulate material in flow that enters the inlet port so that the trapped material does not reach the valve and seat, wherein the valve body comprises an end wall and an annular side wall extending from the end wall to bound an internal chamber space within the valve body, the valve seat is disposed on the end wall, the annulus comprises a structural support ring having an annular side wall containing at least one through-hole, the filter medium comprises a ring circumferentially girdling the annular side wall of the support ring in covering relationship to the outside of the at least one through-hole, and the filter medium is spaced from the valve body side wall to leave an annular zone of the chamber space surrounding the filter medium.

12. A canister purge valve assembly as set forth in claim 11 in which the annulus comprises an axial end sealed to the valve body end wall in circumscribing relation to the valve seat, and further including a solenoid actuator comprising an electromagnet coil mounted on a bobbin, wherein the annulus comprises an opposite axial end sealed to the bobbin.

13. A canister purge valve assembly as set forth in claim 12 in which the support ring comprises a radial flange at the opposite axial end of the annulus, the radial flange sealing to the bobbin.

14. An evaporative emission control system for a fuel supply system of an automotive vehicle comprising a purge flow path extending between an evaporative emission containment space and an engine, including a purge valve assembly for purging fuel vapors from the containment space to the engine under conditions conducive to purging, wherein the purge valve assembly comprises a body having an inlet port communicated to the containment space and an outlet port communicated to the engine, a flow passage through the body between the inlet port and the outlet port, an annular valve seat in circumscribing relation to the passage, an actuator operating a valve relative to the valve seat to selectively restrict flow through the passage, and a particulate filter disposed to trap certain particulate material in flow that enters the inlet port and flows in a radial direction through the filter so that the trapped material does not reach the valve and seat.

15. An evaporative emission control system as set forth in claim 14 in which the purge valve further includes a counter-force mechanism that, when the valve is closing the passage, applies a counter-force to the valve opposite the force due to pressure differential between the inlet and outlet ports.

16. An evaporative emission control system for a fuel supply system of an automotive vehicle comprising a purge flow path extending between an evaporative emission containment space and an engine, including a purge valve assembly for purging fuel vapors from the containment space to the engine under conditions conducive to purging, wherein the purge valve assembly comprises a body having an inlet port communicated to the containment space and an outlet port communicated to the engine, a flow passage through the body between the inlet port and the outlet port, an annular valve seat in circumscribing relation to the passage, an actuator operating a valve relative to the valve seat to selectively restrict flow through the passage, and a particulate filter disposed to trap certain particulate material in flow that enters the inlet port so that the trapped material does not reach the valve and seat, wherein the filter comprises an annulus disposed in circumscribing relation to the seat and comprising a particulate filter medium through which flow through the passage is constrained to pass.

17. An evaporative emission control system as set forth in claim 16 in which the valve body comprises an end wall and an annular side wall extending from the end wall to bound an internal chamber space within the valve body, the valve seat is disposed on the end wall, the annulus comprises a structural support ring having an annular side wall containing at least one through-hole, the filter medium comprises a ring circumferentially girdling the annular side wall of the support ring in covering relationship to the outside of the at least one through-hole, and the filter medium is spaced from the valve body side wall to leave an annular zone of the chamber space surrounding the filter medium.

18. An evaporative emission control system as set forth in claim 17 in which the annulus comprises an axial end sealed to the valve body end wall in circumscribing relation to the valve seat, and further including a solenoid actuator comprising an electromagnet coil mounted on a bobbin, wherein the annulus comprises an opposite axial end sealed to the bobbin.

19. An evaporative emission control system as set forth in claim 18 in which the support ring comprises a radial flange at the opposite axial end of the annulus, the radial flange sealing to the bobbin.

* * * * *